US006644888B2

(12) United States Patent
Ochoa

(10) Patent No.: US 6,644,888 B2
(45) Date of Patent: Nov. 11, 2003

(54) ROADWAY GUARDRAIL STRUCTURE

(76) Inventor: Carlos M. Ochoa, 5353 Keller Springs Rd., Suite 722, Dallas, TX (US) 75248

( * ) Notice: Subject to any disclaimer, the term of this patent is extended or adjusted under 35 U.S.C. 154(b) by 0 days.

(21) Appl. No.: 10/288,203

(22) Filed: Nov. 6, 2002

(65) Prior Publication Data

US 2003/0085394 A1 May 8, 2003

Related U.S. Application Data

(60) Provisional application No. 60/332,887, filed on Nov. 6, 2001.

(51) Int. Cl.[7] ..... E01F 15/00
(52) U.S. Cl. ..... 404/6
(58) Field of Search ..... 404/6, 7; 256/13.1

(56) References Cited

U.S. PATENT DOCUMENTS

| | | | | | |
|---|---|---|---|---|---|
| 1,849,167 | A | * | 3/1932 | Bente | 256/13.1 |
| 1,989,763 | A | * | 2/1935 | McFarland | 256/13.1 |
| 2,047,436 | A | * | 7/1936 | Shepherd | 256/13.1 |
| 2,047,990 | A | * | 7/1936 | Carswell et al. | 256/13.1 |
| 2,942,853 | A | * | 6/1960 | Glaros | 256/13.1 |
| 2,979,307 | A | * | 4/1961 | Crone | 256/13.1 |
| 3,617,076 | A | | 11/1971 | Warren et al. | |
| 5,657,966 | A | | 8/1997 | Cicinnati | |
| 5,954,111 | A | | 9/1999 | Ochoa | |
| 6,082,429 | A | | 7/2000 | Ochoa | |
| 6,220,575 | B1 | * | 4/2001 | Lindsay et al. | 256/13.1 |
| 6,234,437 | B1 | * | 5/2001 | Cabo | 248/220.22 |
| 6,250,360 | B1 | | 6/2001 | Ochoa | |
| 6,250,361 | B1 | | 6/2001 | Ochoa | |
| 6,290,427 | B1 | * | 9/2001 | Ochoa | 404/6 |
| 6,398,192 | B1 | | 6/2002 | Albritton | |
| 6,428,080 | B1 | | 8/2002 | Ochoa | |
| 6,484,464 | B1 | | 11/2002 | Ochoa | |
| 6,533,249 | B2 | | 3/2003 | Ochoa | |

* cited by examiner

*Primary Examiner*—Thomas B. Will
*Assistant Examiner*—Kristine Florio
(74) *Attorney, Agent, or Firm*—Loren G. Helmreich; Browning Bushman, P.C.

(57) ABSTRACT

A guardrail structure having a plurality of vertical support posts supporting a plurality of guardrail beams. Each post includes a pair of flanges having free edge portions with edge folds defining tubular beads on the free edge portions to provide reinforcement that result in a minimum amount of material usage for the posts. Spacers or blockouts may be mounted between the guardrail beams and the posts to offset the posts from the guardrail beams.

38 Claims, 7 Drawing Sheets

33
30
31
13
32
34
36
37
38
39
40
41
42
44
46
48
51
52
56
64
66
70
72
92
141
142
144
146
153
155

FIG. 3
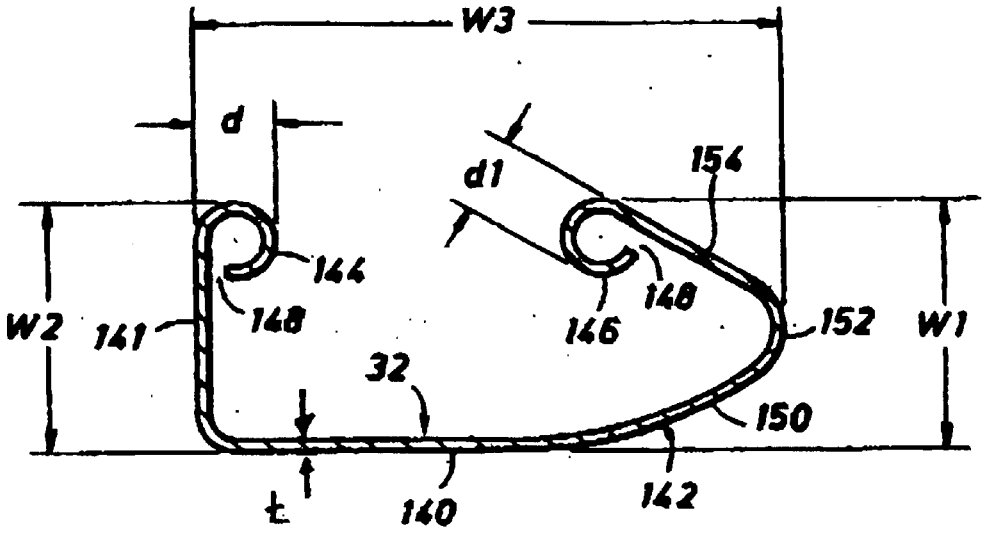
FIG. 4
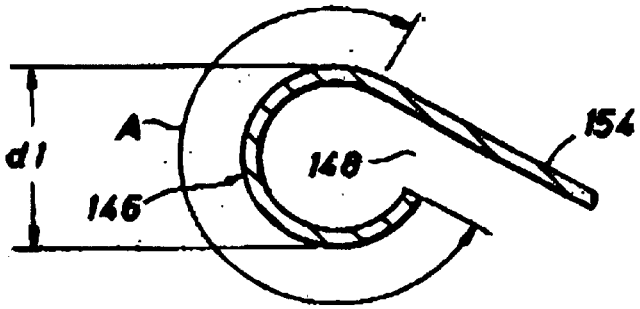
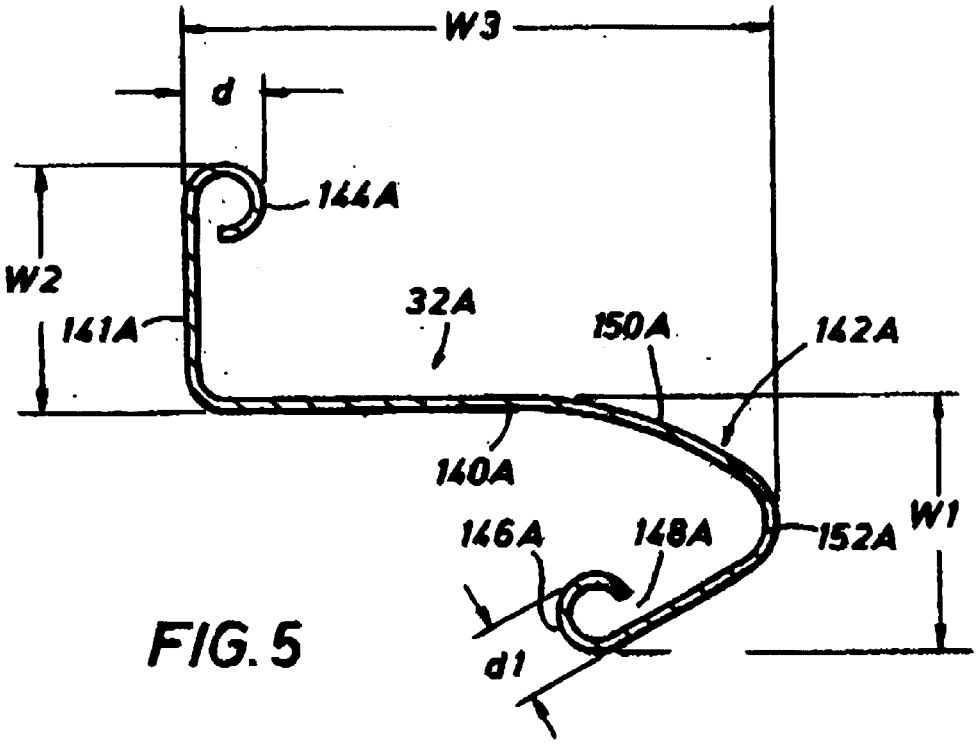
FIG. 5

FIG. 7A
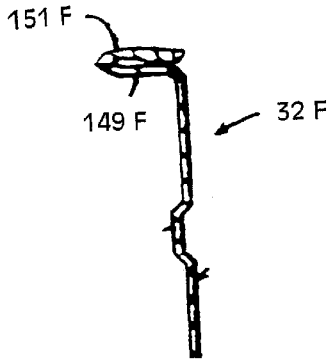
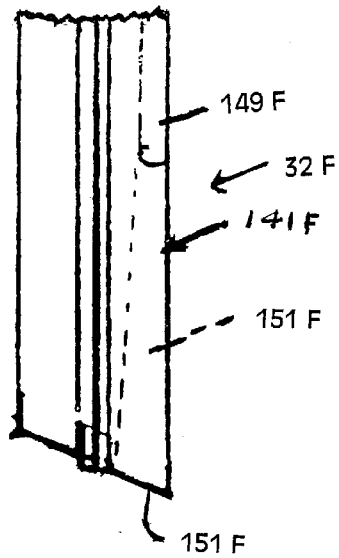
FIG. 7B
FIG. 7C
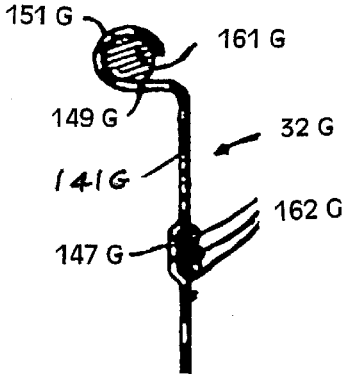

ROADWAY GUARDRAIL STRUCTURE

RELATED APPLICATION

This application claims the benefit of provisional patent application No. 60/332,887 filed Nov. 6, 2001 and entitled Roadway Guardrail Structure.

FIELD OF THE INVENTION

This invention relates generally to a guardrail structure mounted along a roadway, and more particularly to post supports for supporting guardrail beams or panels which extend longitudinally in a direction generally parallel to the roadway.

BACKGROUND OF THE INVENTION

Roadway safety barrier and crash attenuation systems are an important safety feature and component of today's roadways. These systems serve to address the potentially catastrophic results of situations where errant motorists might otherwise leave the relative safety of the designated roadway, or might stray from the safety of normal traffic conventions. They accomplish this by redirecting the vehicle away from a hazardous area in a controlled manner, while absorbing some of the energy of the vehicle through deformation of the system. These systems often include portions having posts that serve as an integral component. This is because posts contribute to the effectiveness, economy of manufacture, ease of installation, and maintenance of these systems, as well as to their reliability.

The posts of a typical safety barrier or crash attenuation system serve to maintain the system in its optimal configuration and state of readiness relative to the roadway, including factors such as height, spacing, support, tension, rigidity, and energy absorption capability. These configuration aspects enable the various components of the system to perform in unison to accomplish their overall purpose of protecting motorists by absorbing and dissipating energy as the system reacts and deforms while responding to errant vehicles. In these applications, the posts are commonly fastened (bolted) or welded to various other roadway features, and may also be partially submerged in the ground in order to give them rigidity as well as to provide a means of anchoring the system while transmitting impact forces to the ground.

Over the past several years, the Federal Highway Administration (FHWA) as well as State Departments of Transportation (TDOT's) throughout the country have increasingly sought to improve the economy, strength, and effectiveness of roadway barrier and crash attenuation systems, including posts, guardrails, fasteners, end treatments, and other components. Thus, installed systems and their components have been required in recent years to sustain increasingly higher levels of economy and performance. This has led to system test requirements that reflect these increasingly higher standards.

Accordingly, these systems are now commonly tested using vehicles having somewhat increased speeds and angles of incidence upon impact with the systems. However, these seemingly small changes in vehicle speed and trajectory may result in substantial increases in the performance requirements of the system. This is because the forces that are imposed upon a system and its components during an impact are highly sensitive to vehicle speed and angle of incidence. Moreover, still additional increases in system forces have been introduced as follows. First, typical test vehicles now have increased mass. Second, the types of test vehicles have been modified to more adequately represent the actual fleet of vehicles on today's roadways. These modifications include vehicles having higher bumpers and centers of gravity, both of which contribute to greater challenges for barrier and crash attenuation systems in achieving-successful performance.

This trend toward increasing economy and performance is very desirable. Yet is has imposed a great challenge on the roadway safety community, because these specifications sometimes seem to require conflicting characteristics of the system. The discussion below describes several aspects of this challenge, with particular emphasis on the implications for existing conventional barrier post designs and the need for innovations that can adequately address the shortcomings of the present state-of-the-art in a cost-effective manner.

The first and most common approach taken by the roadway safety community in addressing these higher requirements has been to make the conventional barriers and posts out of heavier gauge material. For example, heavier gauges of guardrail, made from 0.130 inch thick (10 gauge) material now seem to be more common. I-beam posts are sometimes specified in weights of eight and a half and more pounds of steel per foot. This corresponds to specified flange thicknesses of 0.194 inches, and web thicknesses of 0.170 inches for a W6×8.5 post. In some applications even heavier I-beam posts are used. The use of thicker material has not only led to greater cost for roadway product manufacturers and consumers but also, as will be shown, has had the effect of creating other challenges simultaneously. The following is a discussion of various aspects of these challenges.

The approach of simply increasing material thickness in order to address higher standards may initially seem to minimize the number of changes that are required in updating specific parts of the system, such as the posts. However, this approach may also have some consequences in terms of its effect upon the vehicle. This is because thicker, heavier, and more rigid barrier systems may impose more sudden changes upon the trajectory and speed of an errant vehicle that can in turn affect the vehicle occupants. In addition to this, as the posts are made to be heavier, the posts themselves may become significant obstacles and sources of undesirable local levels of impact to the occupant compartment of the vehicle.

Moreover, in some barrier systems such as guardrail systems, the heavier posts may represent such an obstacle that they often inherently include or otherwise incorporate special characteristics that give them directional strength. This makes them stronger in one direction as compared with the transverse direction with respect to the roadway. One example of this is found in some longitudinal barriers having discontinuities or terminations near their longitudinal ends. In such cases it is often desirable to permit some of the end terminal posts to selectively break away or collapse to the ground rather than represent an obstacle that might unduly damage the vehicle if the end terminal region is struck head-on by a vehicle.

But the increase mass of barrier posts are not the only challenge facing the present state-of-the-art for barrier and crash attenuation system posts. The following is a discussion of some additional considerations that need to be addressed. In this discussion, specific geometrical features are discussed along with their performance characteristics.

Several types of posts are commonly used today in roadway barrier systems. One very common type of post that is found in roadway barrier systems is made of wood. These posts may be of round or rectangular cross-section. Others are hybrids that are made of metals such as steel in combination with materials such as wood or plastic. Hybrid posts are not considered to be extremely viable because of processing costs, and because of complexities associated with maintaining strong and viable interfaces between the materials over extended periods of sunlight, moisture, and temperature cycling during service.

Steel posts include those that have sections that are hot-rolled, cold rolled, or "built up" or joined sections that may represent open or closed cross-sections. Material cost, durability, reliability, and maintenance issues have favored a trend toward steel posts over wood or hybrid systems. However, these posts have remained relatively the same over the past few decades. Cost is always a consideration as more rigid (and thus generally heavier) conventional posts are considered. Other considerations are discussed below using the common hot-rolled steel I-beam post as an example.

Hot-rolled I-beam sections have become even more popular in recent years as the price of wood has risen. These sections consist of simple flat flanges that are joined by a middle web. Guardrail panels are commonly bolted directly to the flanges, and commonly have spacers or "block-outs" to hold the installed guardrail panels away from the posts in order that vehicle tires will not tend to snag on the posts as they contact the barrier system during a crash.

The hot-rolled I-beam post has found favor in the roadway safety industry because it is robust, simple, and permits easy access during assembly for tightening the nuts of the post bolts that hold the guardrail onto the posts. The flat outer surface of the I-beam provides a smooth surface onto which to mount the block-outs and guardrail panels. In addition, this simple shape is relatively easily handled and installed, either into pre-dug holes, or directly into the soil by machines that drive the post into the soil. Finally, when the post is made of steel, it tends to have somewhat greater durability in the field, than when it is made of treated wood. This advantage is especially evident in regions where rainfall, insect, and climate conditions may combine to affect the durability of wood posts.

As simple and useful as the hot-rolled I-beam post has proven to be, it still has inherent aspects that influence its economic potential for future roadway safety applications. One such consideration is that the I-beam cross-section is inherently a sufficiently stable cross-section for the present thicknesses that are manufactured, but may be less stable if thinner material is used. In service it commonly flattens toward the ground in a failure mode called "lateral-torsional buckling" as it experiences high loads during a crash. Buckling is a failure mode that is commonly associated with lower load levels (and thus section stress levels) than the structure is otherwise capable of sustaining. Buckling is discussed in greater detail below. A post section that buckles easily is probably not a weight-efficient design, since it tends not to take full advantage of the maximum strength of the material. Thus, thinner I-beam sections may not be likely candidates for future applications.

This means that thicker sections must commonly be used in order for the I-beam post to adequately resist the buckling failure mode, so that it may in turn provide the required level of rigidity and support to the guardrail system. Moreover, this use of thicker sections has had the effect of making the post heavier, since more material is required.

Another notable effect is that the post becomes more robust in other ways. This robustness is helpful in such cases where it is necessary and cost-efficient to drive the posts into the ground during installation, using semi-automated driving machines. However, some performance challenges have surfaced with the I-beam post that relate to its robustness and to its cross-sectional shape. When installed, I-beam posts most often present a blade edge toward the tires of oncoming vehicles that encounter the guardrail. This may result in the tire somewhat more easily snagging on the post, which may in turn impinge on the vehicle as it interacts with the guardrail. In some cases the tire may be completely separated from the vehicle during a crash as a result of snagging on a post. Naturally, this may have an additional effect upon the vehicle.

Since heavier I-beam posts have represented a mixture of advantages and disadvantages, some of which relate to overall system performance, the highway safety community has sought out alternative and more economical configurations and section shapes. However, only marginal progress has been made in this effort. Some specific challenges are discussed below.

It may be noted here that closed-section posts are not common because they lack the weight-efficiency to represent an economical solution. First, closed sections are generally not as efficient as open sections in achieving sectional properties that resist bending during an impact. In addition, closed sections often lack the ability to hold firm as they interact with the soil during an impact. In addition, closed sections often lack the ability to hold firm as they interact with the soil during an impact, thus necessitating longer sections of buried length in the soil. Finally, closed sections are generally more costly to manufacture than open sections. For these and other reasons, the remainder of this discussion will focus n open section posts.

Open section metal post configurations have included 0.170 inch thick C-shaped cross-sections with blade edges. The C-shaped cross-sections have generally been cold-formed sections that were made by roll forming. One fundamental shortcoming of C-shaped cross-sections in general has been that the blade edges along the length of the post are particularly susceptible to edge instabilities such as edge-buckling or crimping during service and installation.

Edge buckling is a characteristic problem of open section posts in bending, and is related to a free edge stress concentration. It is important because it represents a local failure mode that, having initiated at relatively low stress levels, may propagate across the entire section, causing the post to lose its capability to support the barrier, and thus to fail. This consideration has in fact been a significant driver toward the use of thicker material for most open section post configurations. As a result, these sections have not proven to be competitive because they have not been more economical than hot-rolled I-beam sections.

C-section posts have also been found to generally lack the ability to be effectively driven into the soil by mechanical means during installation. This is because the blade edge "corner" lacks the support of adjacent material and is thus particularly susceptible to local bending as it contacts the soil during installation. The resulting "bent ear" of the corner tends to act like a rudder that distorts the flanges of the section and thus the overall section shape, as the post passes through the soil.

Thus, multiple deficiencies exist for open section posts, including I-beam and C-section posts due to their blade edges. These deficiencies have resulted in roadway barrier posts that are generally more costly, yet are barely adequate to simultaneously meet important design and economic considerations. Consequently, these conventional posts hold limited promise for future economical improvement without innovations that are able to advance the state-of-the-art and to provide the best possible posts for the best possible price to consumers.

In summary, because of increasingly higher safety requirements and the challenges of economy associated with using conventional heavier gauge open section steel posts, there is a need within the industry today for a new stabilized open section metal post configuration that can substantially address all of the above-mentioned drawbacks and shortcomings of the present state-of-the-art, yet is suitable for use with substantially all standardized roadway safety hardware, and can be made on a cost-effective basis. It should also have more stable, tailorable performance characteristics, be economical to manufacture, and be able to conserve some of the desirable capabilities that steel posts offer in general.

SUMMARY OF THE INVENTION

The present invention alleviates and substantially overcomes the above-mentioned problems and shortcomings of the present state of the art through a novel roadway barrier post may be 1) is made of thinner material, 2) performs adequately to enable it to meet new higher roadway safety requirements, 3) may be significantly more resistant to edge buckling during installation and service, 4) effectively addresses edge stress concentrations by modifying the blade edge to an area of relatively low stress, 5) offers enhanced resistance to lateral-torsional buckling, 6) may be manufactured cost-effectively by using conventional manufacturing methods, and 7) may be tailorable in terms of local design characteristics that serve to significantly extend its range of adaptability and usage in roadway barrier systems.

This invention involves a substantially reconfigured or stabilized open section post. The unexpectedly strong synergisms of the characteristics found in the stabilized open section post not only address the above problems, but simultaneously obtain material savings. More particularly the synergisms may be described as follows.

One aspect of the present invention is that it has substantially redistributed material at critical locations as compared with conventional open section post configurations. This material redistribution has the effect of altering considerably the behavior of the post under combined axial, torsional, and bending loads, as compared with conventional steel posts, including open section posts.

Another aspect of the invention is that edge flanges that are formed within specific ranges of angles to adjacent flanges can provide additional edge strengthening for these innovative open section posts. The use of specific ratios of edge flange thickness to the radius between the edge flange and the adjacent flange may provide yet additional strength to the post section, while increasing its ability to absorb energy as a system component.

Yet another aspect of the invention is that the fracture resistance of the edge region is improved through specific combinations of edge flange characteristics such as length, radius, and angle to the adjacent flange. In embodiments that include bolt holes, the resistance of the bolt hole to fracture is substantially improved.

Another aspect of the present invention is that in some embodiments edge flanges or intermediate flanges between other flanges may have ribs. These ribs may be created as flutes or embossments in the axial direction or transverse to the axial direction, in order to increase the strength and buckling resistance of the post. It may be desirable in some instances to have two flutes cross each other in a transverse fashion. Also, the folded edge region itself may have at least one flute if desired.

Still another aspect of the present invention is that in some embodiments, embossing of the web or of specific flanges of the cross-section may be used in order to form reinforcing ribs that increase the overall resistance of the cross-section to lateral-torsional buckling as the post absorbs energy during a crash, or to increase the resistance of the post to nuisance damage and to local impacts during manufacturing, installation, and service. In such cases the embossing may protrude outwardly, away from the cross-section of the post, or inwardly, toward the interior of the cross-section of the post. Such embossing lends itself to roll form processing wherein the embossing is formed within the base sheet material from which the post is formed. However, other methods may also be used to form the reinforcing ribs other than embossing. These may include welding or bonding strips of like or different materials to the post during fabrication or installation of the post.

Another aspect of the present invention is that embossing of specific flanges is provided in order to further accommodate the placement of fasteners such as bolts. In these cases the embossing may also provide increased fracture resistance of the bolted connection. Embossments may be provided in the post cross-section so that two or more post sections may "mate" or interlock with one another in various ways. The embossed or fluted regions may also be roll formed and reinforced locally by adding additional material in order to achieve greater strength during installation or service, or to increase the resistance of the section to specific failure modes. Further, it may be desirable to have one flange made longer than the other in order that the wider flange can serve as a soil plate, in order to achieve manufacturing economies related to not having to weld on a separate soil plate section during fabrication.

An important aspect of the present invention is that the material redistribution required to obtain various collaborative effects is achieved in part by having specifically placed free edge portions, which are turned to define edge folds. The edge folds may be inturned or outturned. They may also be varied in size along the length of the post in order to achieve specific design objectives. The edge folds in one embodiment may comprise tubular beads or curls along the free edges which provide specific design synergisms and manufacturing economies that are consistent with the teachings of the present invention. Moreover, for this embodiment it is not just the presence of the tubular bead or curl that enables the substantial level of synergism, but the discovery of specific ratios of curl diameter to other post section dimensions that maximize these synergisms even to the extent of obtaining significant weight savings.

Another aspect of the present invention is that two sets of synergisms may be combined to make specific embodiments of the present invention even more successful. The first set of synergisms is directly related to the ratio of the diameter of the curl to the post section flange length. Each tubular bead may have cross-sectional dimensions which when combined in specific ratios with other post dimensions substantially maximizes the moment of inertia of the overall section about the section axes with a minimal use of material. Moreover, the tubular bead size specified by these same ratios may have the effect of altering the characteristic failure mode normally associated with the free edge stress concentration for conventional open section posts as described above. Finally, the cross-sectional dimensions of the tubular beads of the stabilized open section post make the novel post less sensitive to edge imperfections and damage because the blade edge may now be placed in a position of relatively benign stress levels so that imperfections or damage to the tube or edge fold region have to be on the order of size of the diameter of the fold or curl in order to have significant detrimental effect to the post section.

Another aspect of the present invention is that for some embodiments, having established the above ratios, a second set of synergisms was discovered by directly combining some of the above synergisms with specific ratios of the post's cross-sectional web dimension to cross-sectional flange dimension. The compounding effect of the first set of synergisms with this additional set of ratios makes the stabilized open section post more resistant to torsion and edge buckling and thus avoids the problems that can plague deeper conventional open section posts using thinner gauge material. Additionally, these compounding synergisms make this particular embodiment unique in that stresses may now be more evenly distributed in the flanges, thus making the post more stable and less sensitive to dimensional imperfections.

Still another aspect of the present invention is that because of specific cooperative effects, some embodiments of the stabilized open section post demonstrate their uniqueness and efficiency in using thinner gauge material to accomplish the same tasks as conventional posts having much thicker sections.

Thus, when compared with conventional posts on the market today, some embodiments of the present stabilized open section post may use substantially thinner material while obtaining better resistance to crash loads on roadway barrier systems. Thus, even though additional slit width (the width of the sheet of material from which the post is made) is required to reposition needed material, the use of thinner gauge material more than offsets the additional slit width, thus bringing overall material savings as high as 18% in some instances.

Another aspect of the present invention is that for some embodiments the innovations in system configuration represent a potential cost savings for the manufacturer, since material cost is often a substantial portion of total manufacturing costs for roadway barrier hardware. The resulting unique and novel open section post may thus be very cost effective.

Another aspect of the present invention is the capability to strengthen the blade edge of open section posts against bending and buckling by redistributing material to the edges, which are typically regions of high stress during machine-aided installation as well as during a crash event. This redistribution can be further enhanced in the following way. In some embodiments the tubular bead is mounted on a turned (e.g. inturned) free edge portion. This enables the tubular bead and the turned free edge portion to act together synergistically. The result is a further stabilization of the cross-section of the post.

When the edge fold embodiment comprises a tubular bead for manufacturing process cost efficiency, preferably an open-section bead, the sheet metal edge fold is formed by turning the edge in an almost complete bend or curl, but the curl need not be closed at its outer edge, such as by welding. Such a closed section tubular bead would work equally well, at a somewhat higher manufacturing cost. This edge feature and other embodiments are discussed in more detail in the following paragraphs.

Another aspect of the present invention is that for some embodiments the edge folds are made by shaping the free edges or edge marginal portions of the flange cross-section into a non-circular, elliptical, or preferably (for manufacturing simplicity) circular, cross-sectional shape. As used herein, a circular cross-section is considered an embodiment of an elliptical cross-section and the term "elliptical cross-section" includes a circular cross-section. The term "characteristic diameter" refers to a constant diameter in the case of a circle, while other elliptical shapes will have major and minor axes or diameters, with the major axis or diameter being the "characteristic diameter." Even though some configurations of a slightly non-circular elliptical shape may be more desirable in some applications, the circular cross-section is generally preferable, because it is simpler to manufacture, while still achieving the desired benefits of edge folds to a significant degree.

For some specific embodiments it is important to contrast the edge curl approach against other possible edge treatment approaches by noting that the dimensional order of size effect related to imperfections or damages described above for the curl can not be achieved by simply folding the edge over, either once or multiple times, because in this case the characteristic dimension will be defined by the fold edge diameter and not by the length of overlap of the fold. This is because the overlap direction is transverse to the edge and quickly moves out of the peak stress region, and because the edge fold diameter defines the maximum distance over which the edge stresses may be effectively spread.

While the edge fold is illustrated as a tubular bead or curl, the edge fold may comprise polygon-shaped open or closed section edge folds. The edge fold shapes or designs may include non-circular, teardrop, elliptical or circular open-section tubular folds, and may be contrasted to tubular sections of rectangular cross-sectional shapes, including those with multiple-folded edges, and to open-section tubular shapes of softened corner polygon cross-sectional shapes in that the characteristic diameter will generally be defined in each of these other cases by the fold diameter or by the softened corner diameter nearest to the post section edge, as opposed to the overall diameter of the edge curl section. It may be noted that in this context, a teardrop, polygon or rectangular cross-section with very softened corners is in effect an imperfect ellipse or circle. In some instances, quasi-elliptical or quasi-circular cross-sections, imperfect ellipses, and imperfect circles, in the form of rectangular cross-sections with very softened corners may function adequately, but may also be more difficult to manufacture and may be less effective than a generally circular curl.

In some embodiments, an important additional edge strengthening and stabilizing capability is obtained by filling portions of the edge fold in cases where the edge fold cross-section is partially open. A simple example of this is inserting a round rod into an open circular shaped edge curl. In this case the rod may be held in place either by welding or bonding, or simply by providing an interference fit between the rod diameter and the inside diameter of the curl. This approach not only accomplishes edge strengthening, but also material redistribution in the post cross-section that can greatly increase the sectional properties such as the second moment of inertia of the post. As an example, this approach may be used to strengthen the post in the region of the "ground line" where an installed post may protrude from the ground where it is installed. The ground line is commonly a region of high stresses during a crash event.

The resulting synergistic effect of the stabilized open section post's material efficiency in obtaining the desired section moment of inertia, the alteration of the characteristic failure mode, the reduction in sensitivity to edge imperfections and damage, resistance to buckling and torsion as well as the ability to spread stresses more uniformly has the same degree of compounding advantage as the conventional I-beam and C-section post's compounding disadvantage of low resistance to lateral-torsional buckling combined with sensitivity to relatively small edge or dimensional imperfections. Accordingly, the novel stabilized open section post of the instant invention provides a solution to the problems that the roadway safety post art has sought to overcome in conventional post configurations available hitherto. In summary, the stabilized open section post of the present invention may be uniquely designed to be compatible with substantially all standard roadway safety barriers, thereby significantly reducing the number of types of posts that manufacturers must carry in their inventories and package, to permit more stringent crash test requirements to be met, and to permit this to be done without major modification of other roadway safety hardware such as guardrails.

It may be noted that in some embodiments it may be desirable to supplement the strength of the edge region even further, with the addition of reinforcing fibers or wires, or even with strips of like or different material that may be attached to the post, such as by bonding, fastening, or welding. One example is the addition of rods to the post near the ground line in order to strengthen the post in this region of high stresses. The rod may be attached to the post, or it may be held in place by specific features of the post. This addition of material may be done for strengthening purposes, or as a means to modify the failure mode of the post further. Naturally, in such cases the manufacturing costs must be weighed along with the benefits obtained in order to establish the best possible product at the best possible cost.

In other embodiments the web or flanges of the post incorporate embossing or one or more flutes that form ribs that serve to strengthen them against buckling during mechanized installation or during service. In addition, in some cases, added beneficial strain hardening of the web or flange region material is obtained as the flutes or embossing are added. In some instances this strengthening may be supplemented or even replaced by local heat treatments, such as by plasma arc, laser, or flame related treatments. These may include the addition of special coatings, or the addition of material. Hydroforming technology may also be used in some cases, such as to form the edge curls, embossing, flanges, or ribs. Variable base material thickness in the post may also be used within the teachings of the present invention.

Another aspect of the present invention is that it has provisions for a modified end, such as to make that end behave somewhat like a blade with tapered edges that permit it to act like a wedge as it is forced into the ground such as by mechanical means during installation. Local heating of these followed by quenching may be used in order to strengthen the base material locally, in order to make the blade region stronger.

The following description of the present invention may incorporate dimensions which are representative of the dimensions which will be appropriate for most commonly found roadway barrier systems. Recitation of these dimensions is not intended to be limiting, except to the extent that the dimensions reflect relative ratios between the sizes of various elements of the invention, as will be explained where appropriate.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which:

FIG. 3 is an enlarged cross-sectional view of a vertical post supporting guardrail beams as shown in FIG. 1;

FIG. 4 is an enlarged sectional view of an edge fold in the form of a curl, on a free end of the post;

FIG. 5 is an enlarged cross-sectional view of a modified post having end flanges extending in opposite directions;

FIG. 7A is an enlarged cross-sectional view of another embodiment of the invention in which the edge folds have been flattened;

FIG. 7B is an enlarged isometric view of a further embodiment of the invention showing tapered flattened edge folds adjacent the lower end of the post;

FIG. 7C is an enlarged cross-sectional view of another embodiment of the invention in which rods are provided for local reinforcement of the edge folds and wires are attached to the flanges in order to provide additional local reinforcement;

DETAILED DESCRIPTION OF THE PREFERRED EMBODIMENT

Several embodiments of the present invention are illustrated and its advantages are best understood by referring now in more detail to FIGS. 1–10 of the drawings, in which like numerals refer to like parts.

Preferred Embodiment of FIGS. 1–4

Figures 1, 1A:
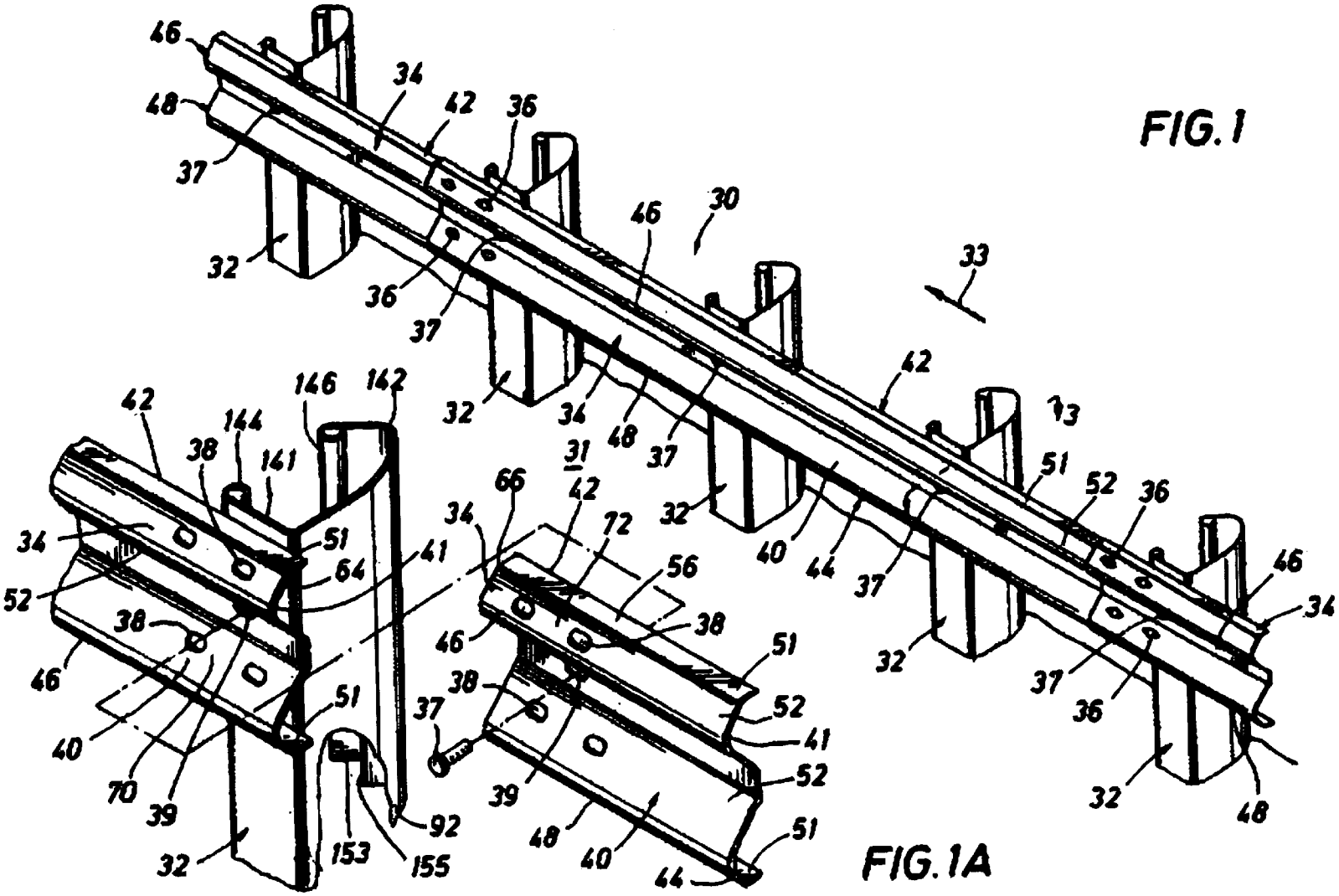
FIG. 1 is an isometric view with portions broken away of a guardrail barrier system or structure installed along a roadway, incorporating teachings of the present invention.
FIG. 1A is an isometric view with portions broken away of a splice or overlapping connection between adjacent guardrail beams or panels, of the guardrail barrier system of FIG. 1.

Referring now to a preferred embodiment shown in FIGS. 1–4, and more particularly to FIG. 1, a guardrail system or structure 30 is shown installed adjacent to roadway 31. The direction of oncoming traffic along roadway 31 is illustrated by directional arrow 33. Guardrail structure 30 includes a plurality of support posts of the present invention 32, anchored adjacent to roadway 31 with a plurality of guardrail beams or panels 34 attached to support posts of the present invention 32, and secured by post bolts 37. For illustrative purposes, FIG. 1 includes one complete guardrail beam 34 and two partial sections of adjacent guardrail beams 34 to illustrate the splice connections between adjoining guardrail beams 34. Guardrail structure 30 may also include conventional posts such as I-beam posts (not expressly shown in the drawings).

Guardrail structure 30 may be installed along roadway 31 in order to prevent motor vehicles (not expressly shown) from leaving roadway 31 and to redirect vehicles away from hazardous areas (not expressly shown) without causing serious injuries to the vehicle's occupants or other motorists. Guardrail systems incorporating aspects of the present invention may be used in median strips or shoulders of highways, along roadways, or any path that is likely to encounter vehicular traffic. Guardrail beam 34 may also be used in conjunction with a variety of guardrail end treatments (not expressly shown) and highway safety energy attenuating systems (not expressly shown), including those currently available and in widespread use.

Support posts of the present invention 32 are provided to support and maintain guardrail beams 34 in a substantially horizontal position along roadway 31. Posts 32 are typically anchored in the ground below or alongside roadway 31. Posts 32 may be fabricated from a variety of materials, including combinations of materials such as metal.

Directionally weakened, collapsible, or "break away" support posts of the present invention may be provided to facilitate a predetermined reaction to a specified crash event. One way to achieve this capability is by placing drawn or stamped shapes in the post section, sometimes near the ground line, that serve to concentrate stresses, thereby helping the post to have directional strength. This is an alternative to placing holes of various shapes in locations that will then cause the post section to buckle or break in a prescribed way when impacted from specific directions. The holes may, for example, be used to reduce the net section of the post in various directions along the surface of the post. The holes may also provide stress concentrations that permit the post to be weakened in specific preferred orientations or directions along the surface of the post. The holes may be round, oval, diamond-shaped, polygon shapes, or similar to these shapes. They may sometimes include sharpened or cut edges that can serve as places from which material failure may occur in a prescribed fashion as desired by the designer, in order to give the post directional strength related to its position with respect to the roadway. One particular application of directionally weakened or "break away" posts is found in end treatments of guardrail installations. Another application is in roadway barrier or crash attenuation cushions of various types.

Figure 2:
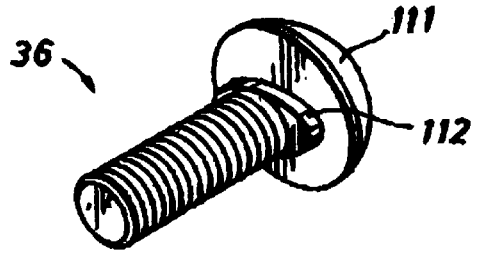
FIG. 2 is an isometric view of a typical splice bolt for connecting guardrail beams to each other.

Referring now to FIGS. 1, 1A and 2, guardrail beams 34 may be secured to support posts 32 through a plurality of elongate post bolt slots 39 and corresponding post bolts 37. Adjacent guardrail beams 34 may be coupled or spliced with one another by a plurality of splice bolts 36 protruding through elongate splice bolt slots 38 and post bolt holes 39. Bolt 36 as shown in FIG. 2 has a head 111 and a flange or shoulder 112 of an elliptical shape which is received within elongate slot 38 and held against rotation. The number, size and configuration of bolts 36 and 37, slots 38 and 39, and holes 39 may be significantly modified within the teachings of the present invention to achieve various design objectives such as directional strength or energy absorption capability. In the illustrated embodiment, the configuration of slots 38 and 39 and bolts 36 and 37 may comply with American Association of State Highway Transportation Officials (AASHTO) Designation M180-89 or later specifications. Specific embodiments may be configured to satisfy NCHRP Report 350 requirements for strong post and weak post guardrail systems. Suitable hardware, including nuts and washers may be provided to secure bolts 36 and 37. Various other mechanical fastening techniques and components may be employed within the teachings of the present invention.

Guardrail beams 34 as shown in FIG. 1A are preferably formed from sheets of a base material such as steel alloys suitable for use as highway guardrail. Note however, that cables may also be used. Roadway barrier posts 32 of the present invention may be manufactured by conventional "roll form" methods using similar steel alloy base materials as those associated with standard heavy gauge W-beam guardrails. Roadway barrier post 32 preferably retains many of the standard interface dimensions associated with conventional standard metal W-beam guardrail installations, when appropriate. In one embodiment, guardrail beam 34 may be designed and fabricated according to AASHTO Designation M180-89. Roadway barrier posts 32 may be incorporated into existing guardrail systems as needed, and an entire retrofit of any particular guardrail system is not required in order to recognize the benefits of the present invention. Roadway barrier post 32, formed in accordance with teachings of the present invention, provides improved performance.

Guardrail beam 34 preferably includes front face 40 and rear face 41 disposed between top edge region 42 and bottom edge region 44. Front face 40 is preferably disposed adjacent to roadway 31. First crown 46 and second crown 48 are formed between top edge region 42 and bottom edge region 44. Both edge region 42 and edge region 44 preferably include an outer edge flange 51 and an adjacent slot flange 52 though the guardrail beam 34 illustrated in FIG. 1 has a generally W-beam shape, other shapes may be suitable for use within teachings of the present invention.

The total length of a typical guardrail beam 34 measured from leading edge 64 to trailing edge 66 is approximately twenty-five (25) feet. Other lengths of guardrail section including, but not limited to one-half lengths, or twelve and one-half foot members, may also be provided within teachings of the present invention.

Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP Report 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after August of 1998 will be required to meet the new standards. The geometric configuration of roadway barrier post 32, as illustrated particularly in FIG. 3, enhances its ability to respond in a more uniform and predictable manner during crash testing and in-service impacts or collisions for both strong and weak post systems as defined in NCHRP Report 350.

As shown particularly in FIG. 1A, upstream end 70 of each guardrail beam 34 is generally defined as the portion beginning at leading edge 64 and extending approximately thirteen (13) inches along guardrail beam 34 toward trailing edge 66. Similarly, downstream end 72 is generally defined as the portion of guardrail beam 34 beginning at trailing edge 66 and extending approximately thirteen (13) inches toward the associated leading edge 64. An intermediate portion of each section of guardrail beam 34 extends between respective upstream end 70 and downstream end 72.

A vehicle traveling along the right side of roadway 31 will approach from upstream end 70 or leading edge 64 and subsequently depart from downstream end 72 or trailing edge 66 of guardrail beam 34. Each section of guardrail beam 34 is preferably joined with additional guardrail beams 34 such that they are lapped in the direction of oncoming traffic to prevent edges that may "snag" a vehicle or object as it travels along front face 40 of guardrail beam 34. Accordingly, a section of guardrail beam 34 installed at leading edge 64 would be installed upon front face 40 of adjacent guardrail beam 34, typically forming an overlap of approximately thirteen inches. An additional guardrail beam 34 installed at trailing edge 66 may be installed upon the rear face 41 of guardrail beam 34, forming an overlap of approximately thirteen inches.

FIG. 1A shows a typical splice connection between adjacent guardrail beams 34. Upstream end 70 and downstream end 72 of adjacent guardrail beams 34 are configured to provide an overlapping splice connection. Guardrail beams 34 are typically fabricated from a flexible sheet metal type material that allows adjacent beams 34 to be deformed and "lapped" together to form the interlock at each splice connection. The interlock at each splice connection helps keep guardrail beams 34 in alignment, with respect to each other, during a crash event. The interlock also operates to direct loads encountered by guardrail system 30 during a crash event in an axial direction along guardrail beam 34. This load path is optimum for bolted-joint or splice connection performance and for overall uniform response of guardrail system 30. This results in maximum energy dissipation from an impacting vehicle. Thus, optimum overall performance of guardrail system 30 is achieved.

Splice bolt slots 38 and post bolt slots 39 are typically elongate, and therefore larger than the respective diameter of bolts 36 and 37 which extend therethrough. Elongate slots 38 and 39 allow bolts 36 and 37 additional movement axially and, therefore, absorb a significant portion of any applied force prior to fracture of bolts 36 and 37. Post bolt slots 39 and post bolts 37 are typically configured similar to, but longer than splice bolt slots 38 and splice bolts 36. This allows post bolts 37 to absorb additional energy during a crash condition. Splice bolt 36 having an elliptical flange 112 for fitting within elongate slots 38 as shown in FIG. 4, represents one example suitable for use within teachings of the present invention.

As shown particularly in FIGS. 3 and 4, post 32 is commonly formed of a sheet metal material such as a steel alloy. It comprises in the typical installed position of a roadway barrier a vertical body, including a web 140 and flanges 141, 142 mounted on each end of web 140. Flange 141 typically serves as the mounting flange upon which guardrail 34 may be secured, where it is typically retained in position by bolts that pass through the guardrail and the mounting flange, with a nut to tighten guardrail 34 into position. Flange 142 has inner and outer flange portions 150, 154 connected by an integral arcuate connecting portion 152. The free edge portions of flanges 141 and 142 are turned inwardly to form edge folds illustrated as open-section tubular beads or edge curls 144 and 146. An open gap 148 is formed adjacent each fold or tubular bead 144, 146. Tubular beads 144, 146 are shown as being of circular configurations or shapes in cross-section to form a circular embodiment of an elliptical cross-section and have outer diameters indicated at d and d1. Tubular beads 144, 146 are turned inwardly an angular amount A of about 270 degrees from flanges 141, 142 as shown in FIGS. 3 and 4 particularly. Thus, gap 148 may be of an angular amount about 90 degrees or less in this case. If desired, tubular beads 144, 146 could be closed although 270 degrees has been found to be optimum. An angular or circular shape for beads 144, 146 as small as about 210 degrees would function in a satisfactory manner in most instances.

While a circular shape for tubular beads 144 and 146 is preferred, a noncircular elliptical shape would function adequately in most instances. A tubular bead or curl of an elliptical shape has a major axis and a minor axis. Diameter or dimension d or d1 for an elliptical shape is interpreted herein for all purposes as the average dimension between the major axis and the minor axis. The major and minor axes are at right angles to each other and defined as the major and minor dimensions of the open or closed tubular section. To provide an effective elliptical shape for tubular beads 144, 146 the length of the minor axis should be at least about 20% of the length of the major axis. The terms "elliptical" shape and "elliptical" cross-section are to be interpreted herein for all purposes as including the embodiments of circular shapes and circular cross-sections in which the major and minor axes are equal. In most instances, diameter d1 for bead 146 is generally equal to diameter d for bead 144 in order to maintain optimal uniform response across the section. However, the diameters may be varied in order to accommodate installation and manufacturing considerations while retaining a significant portion of the benefit.

In order for tubular beads 144, 146 to provide maximum strength with a minimal cross-sectional area of post 32, the diameter d1 of tubular bead 146 is selected according to the width W1 of bowed flange 142 as shown in FIG. 3. A ratio of about 5 to 1 between W1 and d has been found to provide optimum results. A ratio of W1 to d1 of between about 3 to 1 and 8 to 1 would provide satisfactory results. A similar ratio between W2 and d for tubular bead 44 is utilized. As an example of a suitable post 32, W1 is 4 inches, W2 is 4 inches, and W3 is 7 inches. The diameter d for bead 144A is ¾ inch and diameter d1 for bead 146 is ¾ inch.

In order to obtain the desired minimal weight post, tubular edge folds or beads 144, 146 should be shaped and formed within precise ranges and sizes in order to provide maximum strength. Using various design formulae to determine the outer diameters of tubular folds 144, 146 an optimum outer diameter of ¾ inch was found to be satisfactory. It is generally preferred that diameter d1 be similar to diameter d for curl 144. Widths W1 and W2 are between about three (3) and five (5) times the outer diameter of tubular curls 144 and 146 for best results. Width W3 is between about two (2) and five (5) times widths W1 and W2 for best results. By providing such a relationship between tubular curls 144, 146 and widths W1 and W2, the moment of inertia is maximized and edge stress concentrations are minimized for post 32 thereby permitting a light weight construction for post 32 of the present invention. Tubular beads 144, 146 are illustrated as turned inwardly which is the most desirable. In some instances it may be desirable to have a tubular bead or fold turned outwardly.

It may be advisable to form a wedge shape at a lower end of the post when the post is to be installed in rocky soil or in asphalt by being driven into the soil such as by mechanical means, rather than placed into a pre-opened hole in the soil that is then backfilled with soil to provide support for the installed post. The wedge shape of curls 144 and 146 may be formed by flattening curls 144 and 146 as shown at 153 in FIG. 1A along the lower end of the post. Each tapered wedge is generally less than 6" in length so as to minimize changes to the cross-section of the lower end of the post. The wedge shape on the lower end helps the post to penetrate the soil while preserving the stability of the post section as it encounters rocks or other obstacles. The lower end of the post may also be strengthened through the use of reinforcing ribs or local treatment of the metal to make it harder. Also, a portion of the beads as shown at 155 in FIG. 1A may be cut away at their lower ends to provide a wedge shape.

The number, size, shape, manufacturing method, and configuration of support posts 32 of the present invention may be significantly modified within the teachings of the present invention. For instance, support posts may be formed in multiple sections, or of a material that will break away upon impact, such as by directionally weakened geometries including holes, slots, or locally deformed regions that change the material thickness, that are appropriately placed. In some instances, it may be desirable to form the support posts from two steel sections. For example, the first metal section may be an I-beam or a tube disposed below roadway 31 and the second metal section may be similar to the embodiment of FIGS. 1–4 and disposed above roadway 31 with means for connecting the two sections together.

Embodiment of FIG. 5

FIG. 5 shows another embodiment of a post in which a generally Z-shaped post 32A has a flange 141A extending outwardly from web 140A in an opposite direction from flange 142A. Tubular curls or beads 144A, 146A and flange portions 150A, 152A and 154A together with the dimensions shown at W1, W2, W3, d, and d1 are similar to the embodiment of post 32 as shown in FIG. 3. The primary change in the embodiment of FIG. 5 from the embodiment 32 of FIG. 3 is the direction in which mounting flange 141A extends. By having flanges 141 and 141A extending in opposite directions, easy access is enabled to flanges 141A, and to their bolt connections.

Figure 6:
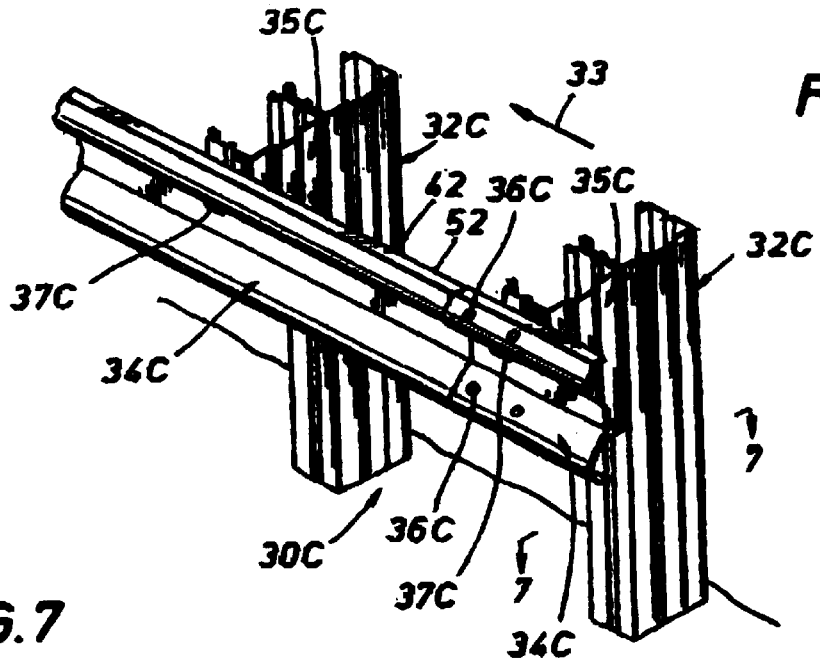
FIG. 6 is an isometric view of another embodiment of the invention in which a metallic spacer or offset block is provided between the vertical post and the guardrail beams to space the posts from the guardrail beams and vehicle impacts.
Figure 7:
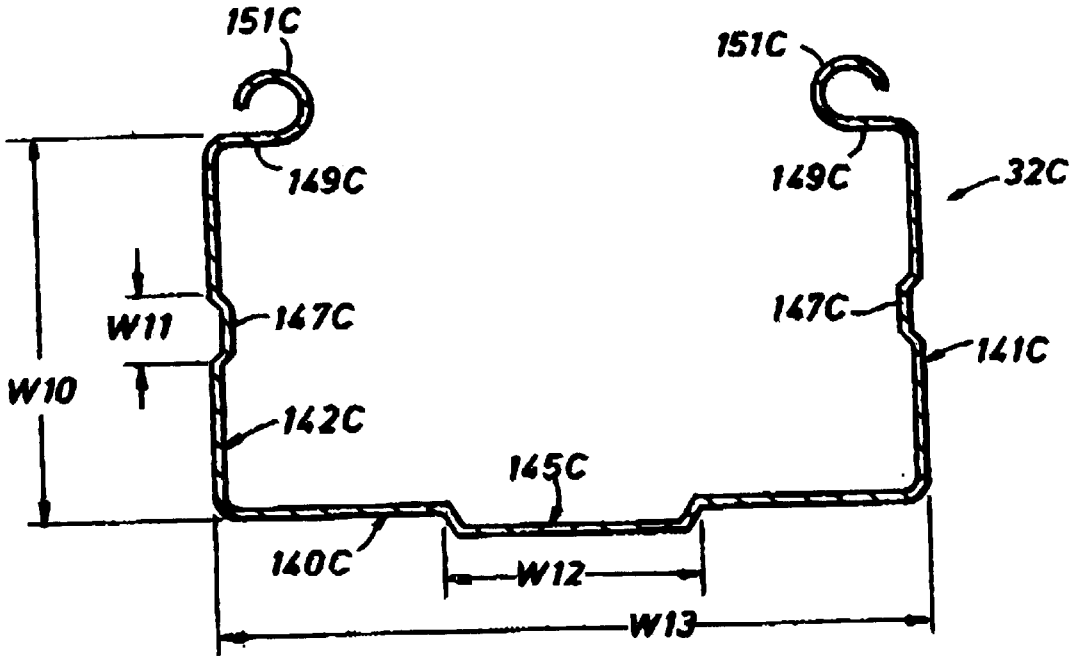
FIG. 7 is an enlarged sectional view of the modified post utilizing the embodiment of FIG. 6 and taken generally along line 7—7 of FIG. 6.

Embodiment of FIGS. 6 and 7

Another embodiment of a guardrail structure is shown in FIGS. 6 and 7 in which a guardrail structure 30C includes guardrail beams 34C supported by posts 32C. Spacer, offset blocks, or blockout members 35C of the present invention are provided between guardrail beams 34C and posts 32C to space posts 32C from guardrail beams 34C and vehicular impacts against guardrail beams 34C. Spacer member 35C may deform slightly upon a high impact force from a vehicle and may be effective in absorbing a portion of the impact forces thereby. Spacer 35C of the present invention preferably has a cross-section similar to post 32C and may be manufactured in a similar manner. Guardrail structure 30C may also include conventional I-beam posts (not expressly shown) and wood offset blocks (not expressly shown).

Post 32C is generally channel shaped having a web or body 140C and flanges 141C and 142C extending at substantially right angles to opposed ends of web 140C. Web 140C has a reinforcing rib or embossment 145C thereon. Flanges 141C and 142C have reinforcing ribs or embossments 147C thereon. Such reinforcing ribs typically protrude a distance of less than six times the thickness of the respective web or flange base sheet material. Each flange 141C and 142C has an inturned free edge portion 149C and an outturned tubular bead 151C is provided at the free end of free edge portion 149C. Ribs 145C, 147C and tubular beads 151C provide substantial reinforcement. The width W11 of rib 147C is between 10% and 40% of the width W10 of flange 141C or 142C. The width W12 of rib 145C is between 20% and 40% of the width W13 of web 140C as shown in FIG. 7. As a specific example of post 32C, web 140C may have a width W13 of 7 inches, rib 145C may have a width W12 of 2 inches, flanges 141C, 142C may have a width W10 of 4 inches, and the tubular edge curls 151C may have an outer diameter of 0.75 inches and extend in a generally circular path of about 250 degrees. Ribs 147C may have a width W11 of 1 inch, and a thickness of 0.096 inches. Post 32C is generally of a uniform thickness, within steel mill production tolerances. Tubular beads 151C may be similar to the tubular bead shown in FIG. 4 for the embodiment of FIGS. 1–4. While spacer member 35C has a cross-section similar to the cross-section of post 32C, the length of offset or spacer member 35C may generally be equal to or greater than the width of guardrail beams 34C. If desired, spacer 35C may extend the entire length of post 32C to provide a double post structure. Spacer member 35C may be effective in spacing posts 32C from direct vehicle contact resulting from impacts against the guardrail structure.

It may be desirable in some instances to have flange 141C extend in an opposite direction from flange 142C to form a generally Z-shape with flanges generally at angles of 90 degrees or less to the web, as shown in the embodiment of FIG. 5. Such a shape may be desirable, such as in medians where guardrail beams are mounted on both sides of the post, and access to guardrail mounting bolts may be aided by this configuration as the oppositely extending flanges may be more easily accessible.

Embodiments of FIGS. 7A and 7B

FIGS. 7A and 7B show modifications in which the free edges of the posts are strengthened or reinforced. Post 32F of FIG. 7A is similar to post 32C and has an outturned free edge 151F which has been flattened against adjacent edge flange 149F for reinforcement. It may be desirable, in some instances, to have a lower end of flattened free edge 151F tapered outward in a downward direction to provide for reinforcing the lower edge on 151F for being forced or driven into the ground.

Referring to FIG. 7B, post 32F has an edge fold including a tubular bead 149F on a free edge flange 141F. Bead 149F is gradually flattened against the adjacent flange and tapers in an outward direction from the lower end of bead 149F to provide an increased strength for driving post 32F in the ground.

FIG. 7C shows rods 161G and bonded wires 162G attached to post 32G for the purpose of selective reinforcement of the post section. Reinforcing rod 161G is positioned within tubular bead 151G to provide synergistic reinforcement. Wires or small diameter rods 162G are provided adjacent embossment 147G to provide strengthening of flange 141G. These reinforcements may be placed at regions of high crash event stress, such as near the ground line. The rods and wires in one embodiment extend for 11 inches along the length of the post.

Figure 8:
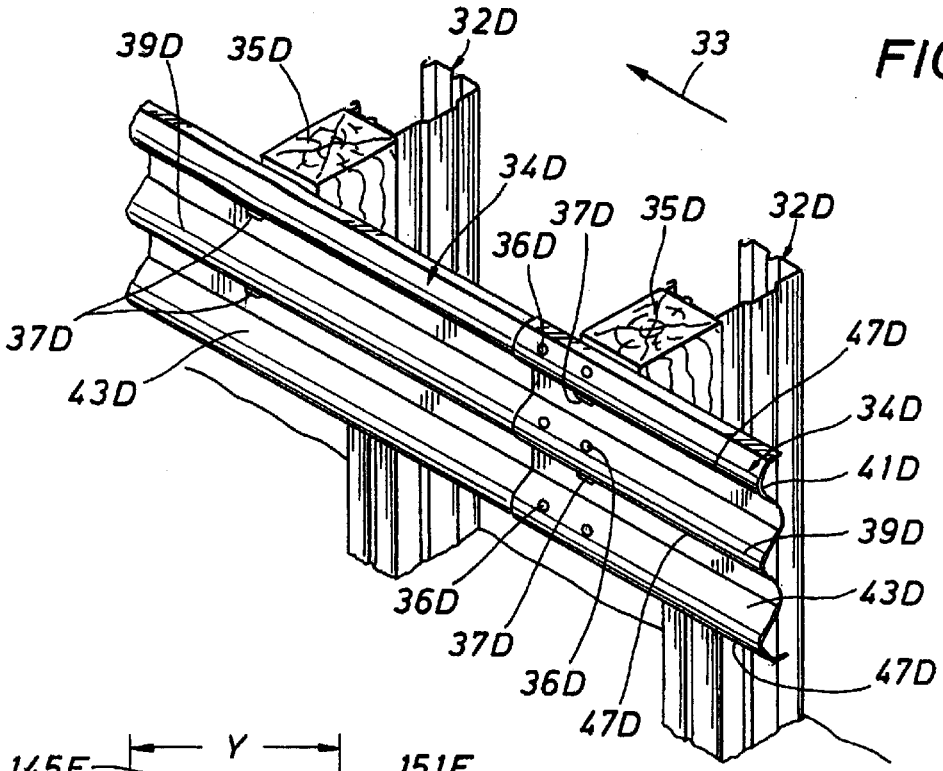
FIG. 8 is an isometric view of a further embodiment of the invention in which a wooden spacer is mounted between the vertical post and the guardrail beams.

Embodiment of FIG. 8

A further embodiment of a guardrail structure is shown in FIG. 8 in which wooden spacer members 35D are mounted between guardrail beams 34D and posts of the present invention 32D. Each guardrail beam 34D has an additional corrugation defined by intermediate corrugation 39D between side corrugations 41D and 43D. Corrugations 39D, 41D and 43D form crowns 47D. Bolts 36D and 37D are preferably long bolts for penetration of wooden spacer member 61D. Spacer 61D has external dimensions generally similar to spacer 35C in the embodiment shown in FIG. 6. Post 32D is similar to the external dimensions of post 32C shown in FIG. 7.

Figure 10:
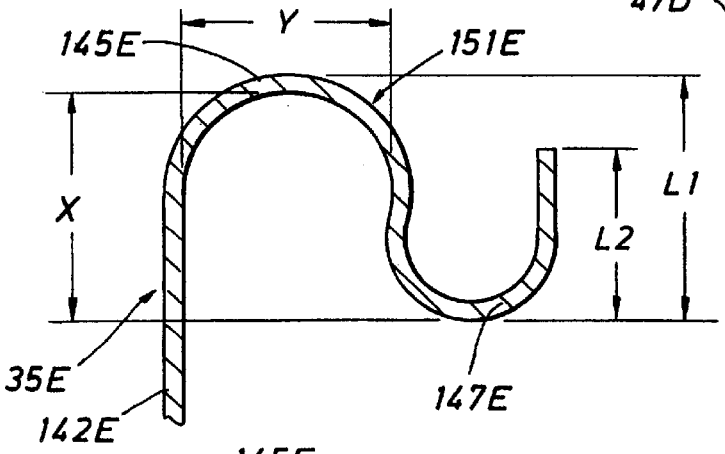
FIG. 10 is an enlarged sectional view of the double bead shown in FIG. 9.
Figure 9:
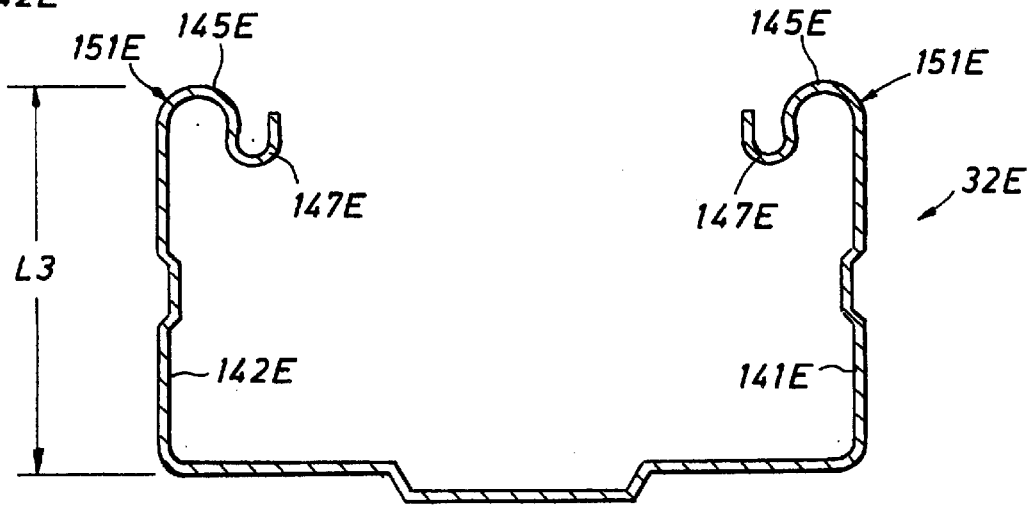
FIG. 9 is an enlarged sectional view of a further modified spacer in which the free edges of the spacer have a double bead or curl for reinforcement.

Embodiment of FIGS. 9 and 10

A further embodiment of a post is shown in the embodiment of FIGS. 9 and 10. Post 32E of the present invention has tubular beads generally indicated at 151E formed on the free edges of flanges 141E and 142E of post 32E. It may be desirable to form the free edge of flanges 141E and 142E with a double fold as shown in FIG. 10 in order to achieve specific design objectives. Curl or bead 151E on flange 142E has a primary inturned curl portion or fold 145E and an auxiliary outturned end curl portion or fold 147E. Curl portion 145E has a major axis X and a minor axis Y. Minor axis Y is at least 20% of the major axis X and preferably at least 40% of major axis X. Auxiliary outturned curl portion 147E is of a length L2 and primary inturned curl portion 145E is of a length L1. Length L2 is at least about 25% of length L1 and preferably at least about 50% of length L1. Length L1 is at least about 15% of length L3 of flange 142E. Outturned end curl portion 147E provides reinforcement for main curl portion 145E. Tubular bead 151E thus includes two folds, one fold being an inward fold for main curl portion or body 145E and the other fold being an outturned fold for auxiliary end curl portion 147E. While a double fold has been illustrated for post 32E, a similar double fold may be utilized if desired for the posts shown in the other embodiments. It is apparent that a double folded edge provides additional reinforcement.

Figure 11:
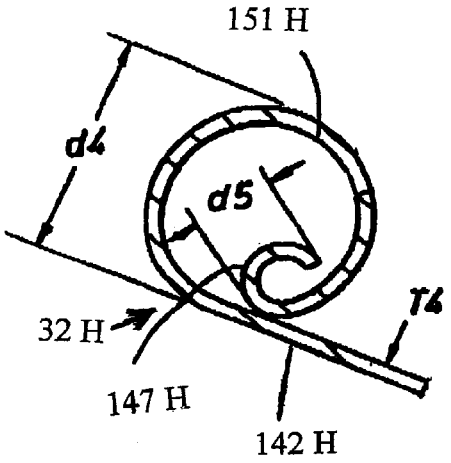
FIGS. 11 and 12 are enlarged sectional views of further embodiments of the invention in which the edge folds utilize folded ends to accomplish additional reinforcement of the fold itself.
Figure 12:
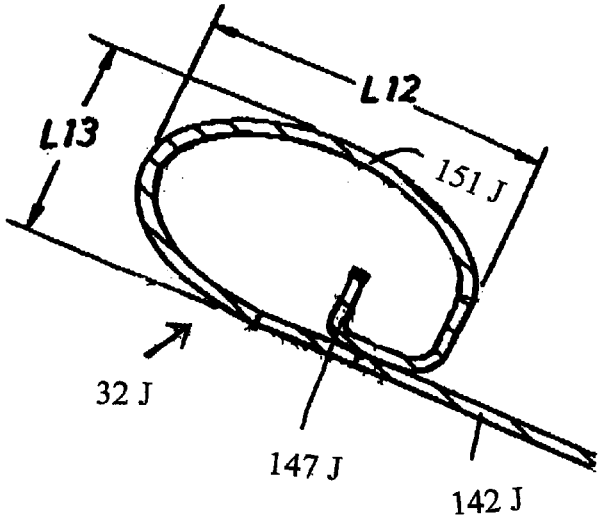

Embodiments of FIGS. 11 and 12

FIGS. 11 and 12 show further embodiments of reinforcing the free edges side flanges in posts. In FIG. 11, for example, flange 142H of post 32H has a tubular bead 151H of a generally circular shape with a diameter shown as d4. An inner curl or lip of a circular configuration shown as 147H contacts flange 142H and has a diameter d5 about one-third of diameter d4 thereby to provide a tubular bead or curl within a tubular bead. Such an arrangement is desirable particularly if the ratio of the diameter d4 is greater than fifty (50) times thickness T4 of flange 142H.

Referring to FIG. 12, outer bead 151J is formed on side flange 142J of post 32J and is of an elliptical shape with the major axis L12 being larger than the minor axis L13. Inner curl or lip 147J is of a channel shape and is in contact with flange 142J. Likewise, the arrangement of FIG. 12 is particularly desirable when the ratio of major axis L12 to the thickness of flange 142J is greater than fifty (50).

Figure 13:
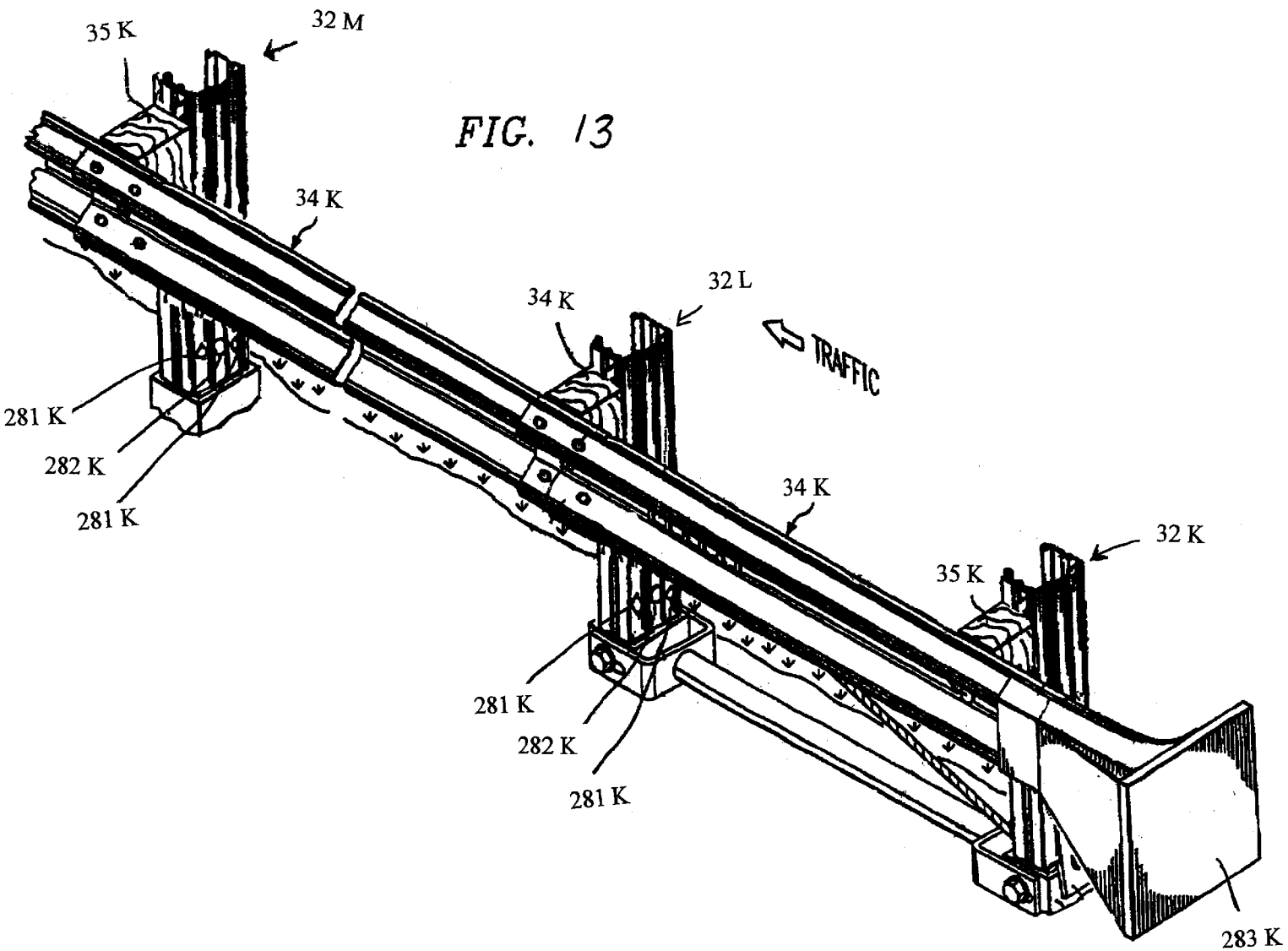
FIG. 13 is an isometric view of a section of an end terminal installation using "break away" or collapsible posts of the present invention.

Embodiment of FIG. 13

As shown in FIG. 13 a plurality of posts 32K, 32L, and 32M are shown with spacers 35K between the posts and the guardrails 34K similar to the embodiment of FIG. 8. Posts 32K, 32L, and 32M may be provided with weakened portions, such as openings 281K and 282K at selected locations on the posts as may be desired. In one embodiment, the intermediate cross section of the post is specifically designed to have an inherent buckling behavior that accomplishes the desired weakening. This has the double benefit of limiting the maximum loads exerted by the post upon the vehicle- and accomplishing this in a prescribed, stable manner, while also providing a collapse mechanism for the post as the vehicle passes over it after impacting it.

As shown in FIG. 13, an end terminal structure includes end abatement plate 283K connected on to the end of the guardrails 34K and is positioned to receive vehicle impacts. Posts 32K, 32L, and 32M are arranged with openings in a row so that they will successfully collapse as "breakaway" posts in the event a vehicle impacts in end abatement plate 283K.

In order to provide further enhanced directional strength, drawn or stamped shapes including embossments or dimples may be provided in the post. These are in lieu of holes, and serve much the same purpose of concentrating stresses and interacting with each other differently according to the direction of the impact forces on the post, thus providing directional strength to the post. Holes would also serve a similar purpose. For example, post 32K could have drawn or stamped shapes, and post 32L could have holes at similar locations. Thus, holes and drawn or stamped shapes could be used in one post, and holes in another post, in the same end terminal installation such as shown in FIG. 13. Posts may be arranged in a row such that they will successively collapse as "break away" posts as a vehicle impacts the end terminal structure.

As a result of providing the folds in the form of tubular beads along the marginal edge portions of the post, an unexpectedly significantly thinner gauge material generally about eighteen percent lighter has been utilized for the post as compared with prior art posts as utilized heretofore. By utilizing precise tubular beads as set forth herein on the selected members where it is most needed for strength, a manufacturer may utilize an unexpectedly substantially thinner gauge material while eliminating or minimizing problems encountered heretofore by prior art designs of posts, such as used in roadway barrier systems.

While the particular invention as herein shown and disclosed in detail is fully capable of obtaining the objects and providing the advantages hereinbefore stated, it is understood that this disclosure is merely illustrative of the presently preferred embodiments of the invention and that no limitations are intended other than as described in the appended claims.

What is claimed is:

1. A support post for mounting a guardrail of a highway guardrail system, comprising:

an elongated body having an upper end, a lower end, and an intermediate portion between said ends with substantially vertical surfaces;

a securing member for attachment of the guardrail to the elongated body adjacent to the upper end; and said intermediate portion of said body including in horizontal cross-section a web with two ends, and a flange at each end with an edge fold including an inturned free edge portion and a generally tubular bead on a free edge of at least one flange, such that when the post is impacted by a vehicle, the impact force causes the cross-section of said intermediate portion to buckle and deform in a region adjacent to the point of impact, thereby reducing the ability of the post to resist said vehicle impact.

2. The support post of claim 1, wherein said tubular bead has an elliptical cross-section with a minor axis that is at least 20% of a major axis.

3. The support post of claim 1, wherein said web has a thickness between 0.060 inch and 0.190 inch.

4. The support post of claim 3, wherein a major axis and a minor axis of an elliptical cross-section of the edge fold are substantially equal to each other, thus defining a circular cross-section and the edge fold extends through a circular path of at least about 210 degrees.

5. The support post of claim 1, wherein said edge fold is turned inwardly and the flanges are oriented substantially perpendicular to the web.

6. The support post of claim 1, wherein said post is formed from a single sheet of galvinized base metal.

7. The support post of claim 1, wherein the post is substantially uniform in cross-section along said intermediate portion.

8. The support post of claim 1, wherein at least one of the flanges has a reinforcing rib.

9. The support post of claim 1, wherein at least one of said flanges at each end of the intermediate portion of the body is bowed in at least one direction.

10. The support post of claim 1, further comprising:

a spacer member mounted between said post and a guardrail to space said post from said guard rail.

11. The support post of claim 10, wherein the horizontal cross-section of said spacer is substantially identical to the horizontal cross-section of said post.

12. The support post of claim 11, wherein said spacer extends for the length of said post.

13. The support post of claim 1, wherein said securing member comprises a bolt.

14. The support post of claim 1, wherein said cross-section includes at least one embossment protruding away from said web.

15. A support post for mounting a guardrail thereon as part of a highway guardrail system for installation adjacent to a roadway, comprising:

an elongated body having an upper end, a lower end, and an intermediate portion with substantially vertical surfaces;

a securing member for attachment of the guardrail to the elongated body adjacent to the upper end;

said intermediate portion of said elongated body including in cross-section a web with two ends, and flange at each end with an edge fold with an inturned free edge portion and an outturned tubular bead on the inturned free edge portion; and at least one of the flanges including an embossment protruding away from the flange an amount between one half and eight times the thickness of the flange.

16. The support post of claim 15, wherein said edge fold is inturned.

17. The support post of claim 15, wherein said tubular bead has an elliptical cross-section with a minor axis that is at least 20% of a major axis.

18. The support post of claim 17, wherein the major and minor axes of said elliptical cross-section of the edge fold are substantially equal to each other, thus defining a circular cross-section and the edge fold extends through a circular path of at least about 210 degrees.

19. The support post of claim 15, wherein said edge fold is turned outwardly and the flanges are oriented substantially perpendicular to the web.

20. The support post of claim 15, wherein the elongated body is substantially uniform in cross-section along its entire length, and said lower end of said elongated body is tapered to provide a wedge-shaped edge to penetrate the ground when the elongated body is installed.

21. The support post of claim 15, wherein each flange has an inturned free edge including said edge fold thereon, said edge fold formed by lapping over a portion of the free edge.

22. The support post of claim 15, wherein said edge fold is circular in cross-section and extends through an arc of at least about 210 degrees.

23. The support post of claim 15, wherein said securing member is a bolt.

24. A highway guardrail system for a roadway, comprising:

a plurality of spaced guardrail support posts along the roadway;

a guardrail mounted on said support posts;

at least one support post having an elongated body including an upper end, a lower end, and an intermediate portion between said ends with substantially vertical surfaces; and said intermediate portion defining in cross-section a web with two ends, and a flange at each end with an edge fold, a tubular bead and an additional reinforcing member within said tubular bead.

25. The highway system as defined in claim 24, wherein said at least one support post adjacent the guardrail has a weakened section to provide a breakaway post upon a vehicle impact against said at least one support post.

26. The highway guardrail system as defined in claim 25, wherein said at least one post having a weakened cross-section includes a plurality of openings in the post to provide the weakened cross-section.

27. The highway guardrail system as defined in claim 24, wherein said edge fold is elliptical in cross-section having a minor axis that is at least about 20% of a major axis.

28. The highway guardrail system as defined in claim 24, wherein said edge fold has an inturned edge portion.

29. The highway guardrail system as defined in claim 25, wherein an end abutment member is mounted on an end of said guardrail for receiving vehicle impact loads.

30. The highway guardrail system as defined in claim 28, wherein said inturned edge portion includes an inturned flange portion having a double thickness flattened edge section.

31. The highway guardrail system as defined in claim 29, wherein said additional reinforcing member within said tubular bead comprises a tubular bead in cross-section.

32. The highway guardrail system as defined in claim 24, wherein said web is reinforced by at least one flute to define a reinforcing rib that protrudes away from the web an amount between one-half and eight times the thickness of the web.

33. A support post for mounting a guardrail of a highway guardrail system, comprising:

an elongated body having an upper end, a lower end, and an intermediate portion between said ends with substantially vertical surfaces;

a securing member for attachment of the guardrail to the elongated body adjacent to the upper end; and said intermediate portion of said body including in horizontal cross-section a web with two ends, and flange at each end with an edge fold on a free edge of at least one flange, wherein a major axis and a minor axis of an elliptical cross-section of the edge fold being substantially equal to each other, thus defining a substantially circular cross-section and the edge fold extends through a circular path of at least about 210 degrees, such that when the post is impacted by a vehicle, the impact force causes the cross-section of said intermediate portion to buckle and deform in a region adjacent to the point of impact, thereby reducing the ability of the post to resist said vehicle impact.

34. The highway guardrail system as defined in claim 33, wherein said edge fold is turned inwardly and the flanges are oriented substantially perpendicular to the web.

35. The highway guardrail system as defined in claim 33, wherein at least one of said flanges at each end of the intermediate portion of the body is bowed in at least on direction.

36. A support post for mounting a guardrail thereon as part of a highway guardrail system for installation adjacent to a roadway, comprising:

an elongated body having an upper end, a lower end, and an intermediate portion with substantially vertical surfaces;

a securing member for attachment of the guardrail to the elongated body adjacent to the upper end;

said intermediate portion of said elongated body including in cross-section a web with two ends, and a flange at each end with an edge fold along a free edge, said edge fold being turned outwardly and the flanges being oriented substantially perpendicular to the web, the edge fold including a tubular bead; and at least one of the flanges including an embossment protruding away from the flange an amount between one half and eight times the thickness of the flange.

37. This highway guardrail system as defined in claim 36, wherein the edge fold extends through a circular path of at least about 210 degrees.

38. This highway guardrail system as defined in claim 36, wherein each flange has an inturned free edge including said edge fold thereon, said edge fold formed by lapping over a portion of the free edge.

* * * * *